US011502412B2

(12) United States Patent
Yao et al.

(10) Patent No.: US 11,502,412 B2
(45) Date of Patent: Nov. 15, 2022

(54) ANTENNA CONFIGURED TO TRANSMIT OR RECEIVE SIGNAL, SMART WINDOW, AND METHOD OF FABRICATING ANTENNA

(71) Applicant: BOE Technology Group Co., Ltd., Beijing (CN)

(72) Inventors: Yuan Yao, Beijing (CN); Lei Wang, Beijing (CN); Tienlun Ting, Beijing (CN)

(73) Assignees: BOE Technology Group Co., Ltd., Beijing (CN); Beijing University of Posts and Telecommunications, Beijing (CN)

( * ) Notice: Subject to any disclaimer, the term of this patent is extended or adjusted under 35 U.S.C. 154(b) by 221 days.

(21) Appl. No.: 16/756,113

(22) PCT Filed: Jun. 17, 2019

(86) PCT No.: PCT/CN2019/091560

§ 371 (c)(1),
(2) Date: Apr. 14, 2020

(87) PCT Pub. No.: WO2020/140396

PCT Pub. Date: Jul. 9, 2020

(65) Prior Publication Data

US 2020/0295458 A1 Sep. 17, 2020

(30) Foreign Application Priority Data

Jan. 3, 2019 (CN) ..... 201910004275.5
Jan. 3, 2019 (CN) ..... 201910004663.3

(51) Int. Cl.
*H01Q 1/38* (2006.01)
*H01Q 5/35* (2015.01)
(Continued)

(52) U.S. Cl.
CPC ..... *H01Q 5/35* (2015.01); *H01Q 1/36* (2013.01); *H01Q 1/38* (2013.01); *H01Q 21/26* (2013.01)

(58) Field of Classification Search
CPC .. H01Q 5/35; H01Q 1/36; H01Q 1/38; H01Q 21/26; H01Q 9/065; H01Q 5/25; H01Q 9/28
See application file for complete search history.

(56) References Cited

U.S. PATENT DOCUMENTS

2005/0088344 A1* 4/2005 Saitou ..... H01Q 9/28 343/700 MS
2011/0037656 A1 2/2011 Bremner et al.
(Continued)

FOREIGN PATENT DOCUMENTS

CN 1833474 A 9/2006
CN 101188324 A 5/2008
(Continued)

OTHER PUBLICATIONS

International Search Report & Written Opinion dated Oct. 9, 2019, regarding PCT/CN2019/091560.
(Continued)

*Primary Examiner* — David E Lotter
(74) *Attorney, Agent, or Firm* — Intellectual Valley Law, P.C.

(57) ABSTRACT

An antenna configured to transmit or receive a signal is provided. The antenna includes a substantially transparent base substrate and an antenna electrode on the substantially transparent base substrate. The antenna electrode includes a substantially transparent conductive layer, and a first conductive line abutting an edge portion of the substantially transparent conductive layer and electrically connected to the edge portion of the substantially transparent conductive layer. An electrical conductivity of the first conductive line
(Continued)

is greater than an electrical conductivity of the substantially transparent conductive layer.

20 Claims, 7 Drawing Sheets

(51) Int. Cl.
*H01Q 21/26* (2006.01)
*H01Q 1/36* (2006.01)

(56) References Cited

U.S. PATENT DOCUMENTS

| | | | | |
|---|---|---|---|---|
| 2014/0158987 | A1* | 6/2014 | Song | H01Q 9/0407 257/29 |
| 2017/0207120 | A1* | 7/2017 | Boyanov | H01L 21/7684 |
| 2018/0323492 | A1* | 11/2018 | Daniel | H01Q 15/0086 |
| 2020/0194899 | A1 | 6/2020 | Lu | |
| 2021/0226325 | A1* | 7/2021 | Yao | H01Q 9/065 |

FOREIGN PATENT DOCUMENTS

| | | | |
|---|---|---|---|
| CN | 101682110 | A | 3/2010 |
| CN | 105609937 | A | 5/2016 |
| CN | 106848554 | A | 6/2017 |
| CN | 108649343 | A | 10/2018 |
| CN | 109066069 | A | 12/2018 |
| JP | H10233612 | A | 9/1998 |
| JP | 2001326518 | A | 11/2001 |
| WO | 2008047953 | A1 | 4/2008 |

OTHER PUBLICATIONS

First Office Action in the Chinese Patent Application No. 201910004275.5 dated Aug. 2, 2019; English translation attached.
Second Office Action in the Chinese Patent Application No. 201910004275.5 dated Dec. 30, 2019; English translation attached.
Third Office Action in the Chinese Patent Application No. 201910004275.5 dated Mar. 25, 2020; English translation attached.
First Office Action in the Chinese Patent Application No. 201910004663.3 dated Sep. 10, 2019; English translation attached.
He, "Naixiao Research no Antenna Technology Based on optically Transparent Film", Chinese Mater's Theses Full-text Database Information Science and Technology, Aug. 15, 2015, No. 201508.
X. Gao, et al., "Optically Transparent Balloon Antenna", 2015 IEEE International Symposium on Antennas and Propagation & USNC/URSI National Radio Science Meeting.
Second Office Action in the Chinese Patent Application No. 201910004663.3 dated May 26, 2020; English translation attached.
Decision of Rejection in the Chinese Patent Application No. 201910004275.5, dated May 25, 2020; English translation attached.

* cited by examiner

ANTENNA CONFIGURED TO TRANSMIT OR RECEIVE SIGNAL, SMART WINDOW, AND METHOD OF FABRICATING ANTENNA

CROSS-REFERENCE TO RELATED APPLICATION

This application is a national stage application under 35 U.S.C. § 371 of International Application No. PCT/CN2019/091560, filed Jun. 17, 2019, which claims priority to Chinese Patent Application No. 201910004275.5, filed Jan. 3, 2019 and Chinese Patent Application No. 201910004663.3, filed Jan. 3, 2019. Each of the forgoing applications is herein incorporated by reference in its entirety for all purposes.

TECHNICAL FIELD

The present invention relates to display technology, more particularly, to an antenna configured to transmit or receive a signal, a smart window, and a method of fabricating an antenna.

BACKGROUND

In general, an antenna is formed using metal materials having good conductive properties. However, those metal materials having good conductive properties are not transparent materials.

SUMMARY

In one aspect, the present invention provides an antenna configured to transmit or receive a signal, comprising a substantially transparent base substrate and an antenna electrode on the substantially transparent base substrate; wherein the antenna electrode comprises a substantially transparent conductive layer; and a first conductive line abutting an edge portion of the substantially transparent conductive layer and electrically connected to the edge portion of the substantially transparent conductive layer; wherein an electrical conductivity of the first conductive line is greater than an electrical conductivity of the substantially transparent conductive layer Optionally, the substantially transparent conductive layer comprises a high current density portion which comprises the edge portion of the substantially transparent conductive layer; and when the antenna is configured to transmit or receive a signal, a current density in the high current density portion of the substantially transparent conductive layer is greater than a current density in other portions of the substantially transparent conductive layer.

Optionally, the substantially transparent conductive layer comprises a first pattern having a first feed point and a second pattern having a second feed point spaced apart from each other, a first width along a first direction, of the first pattern, gradually increases along a second direction substantially perpendicular to the first direction; and a second width along the first direction, of the second pattern, gradually increases along a third direction substantially opposite to the second direction and substantially perpendicular to the first direction.

Optionally, the first pattern and the second pattern have a two-fold symmetry with respective to a two-fold axis intersecting a midpoint of a line connecting the first feed point and the second feed point, and perpendicular to the substantially transparent base substrate; and the first pattern and the second pattern have a substantially mirror symmetry with respect to a plane of mirror symmetry intersecting the midpoint of the line connecting the first feed point and the second feed point, and perpendicular to the substantially transparent base substrate.

Optionally, the first feed point and the second feed point are closest points between the first pattern and the second pattern with respect to each other.

Optionally, the first pattern has a substantial isosceles right triangular shape having the first feed point as one of its apexes; the second pattern has a substantially isosceles right triangular shape having the second feed point as one of its apexes; and the edge portion of the substantially transparent conductive layer comprises at least a portion of two right angle sides of the first pattern connected to the first feed point, and at least a portion of two right angle sides of the second pattern connected to the second feed point.

Optionally, a first normal distance between the first feed point to a side of the first pattern away from the first feed point is in a range of approximately 10 mm to approximately 100 mm; a second normal distance between the second feed point to a side of the second pattern away from the second feed point is in a range of approximately 10 mm to approximately 100 mm; and a distance between the first feed point and the second feed point is in a range of approximately 0.1 mm to approximately 10 mm.

Optionally, the first conductive line is on a side of the edge portion of the substantially transparent conductive layer away from the substantially transparent base substrate.

Optionally, the first conductive line is abutting the edge portion of the substantially transparent conductive layer along a side wall of the edge portion of the substantially transparent conductive layer.

Optionally, the antenna further comprises a first feed line electrically connected to the first pattern through the first feed point; and a second feed line electrically connected to the second pattern through the second feed point; wherein a third width along a fourth direction, of the first feed line, gradually increases along a fifth direction substantially perpendicular to the fourth direction; a fourth width along a sixth direction, of the second feed line, gradually increases along a seventh direction substantially perpendicular to the sixth direction; the fourth direction and the six direction are substantially perpendicular to the first direction; and the fifth direction and the seventh direction are substantially parallel to the first direction.

Optionally, the first feed line and the second feed line have a substantially mirror symmetry with respect to the plane of mirror symmetry.

Optionally, the first feed line and the second feed line have a substantially right triangular shape; and one of two right angle sides of the first feed line is directly adjacent to one of two right angle sides of the second feed line.

Optionally, the antenna further comprises a second conductive line abutting an edge portion of the first feed line and electrically connected to the edge portion of the first feed line; and a third conductive line abutting an edge portion of the second feed line and electrically connected to the edge portion of the second feed line.

Optionally, the edge portion of the first feed line comprises substantially an entirety of a perimeter of the first feed line; and the edge portion of the second feed line comprises substantially an entirety of a perimeter of the second feed line.

Optionally, the second conductive line is on a side of the edge portion of the first feed line away from the substantially transparent base substrate; and the third conductive line is on a side of the edge portion of the second feed line away from the substantially transparent base substrate.

Optionally, the second conductive line abuts the edge portion of the first feed line along a side wall of the edge portion of the first feed line; and the third conductive line abuts the edge portion of the second feed line along a side wall of the edge portion of the second feed line.

Optionally, the substantially transparent conductive layer, the first feed line, and the second feed line are in a same layer and comprise a same conductive material; and the first conductive line, the second conductive line, and the third conductive line are in a same layer and comprise a same conductive material.

Optionally, the antenna further comprise a first metal structure and a second metal structure; wherein the first metal structure is electrically connected to a first side of the first feed line away from the first feed point; and the second metal structure is electrically connected to a second side of the first feed line away from the second feed point.

In another aspect, the present invention provides a smart window, comprising the antenna described herein, and one or more signals lines connected to the antenna.

In another aspect, the present invention provides a method of fabricating an antenna configured to transmit or receive a signal comprising providing a substantially transparent base substrate; and forming an antenna electrode on the substantially transparent base substrate; wherein forming the antenna electrode comprises forming a substantially transparent conductive layer on the substantially transparent base substrate; and forming a first conductive line abutting an edge portion of the substantially transparent conductive layer and electrically connected to the edge portion of the substantially transparent conductive layer; wherein an electrical conductivity of the first conductive line is greater than an electrical conductivity of the substantially transparent conductive layer.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

It is discovered by the present disclosure that in order to have a substantially transparent antenna, the indium tin oxide (ITO) material may be used for making the substantially transparent antenna. However, the antenna made of ITO has a low radiation efficiency.

Accordingly, the present disclosure provides, inter alia, an antenna configured to transmit or receive a signal, a smart window, and a method of fabricating an antenna that substantially obviate one or more of the problems due to limitations and disadvantages of the related art. In one aspect, the present disclosure provides an antenna configured to transmit or receive a signal. In some embodiments, the antenna includes a substantially transparent base substrate and an antenna electrode on the substantially transparent base substrate. Optionally, the antenna electrode includes a substantially transparent conductive layer, and a first conductive line abutting an edge portion of the substantially transparent conductive layer and electrically connected to the edge portion of the substantially transparent conductive layer. Optionally, an electrical conductivity of the first conductive line is greater than an electrical conductivity of the substantially transparent conductive layer.

Figure 1:
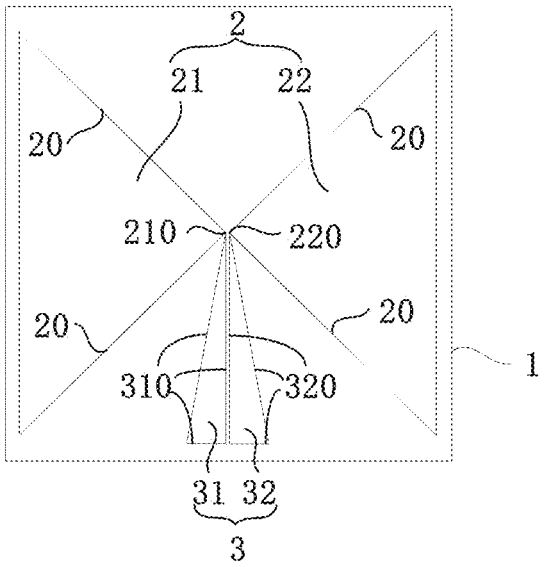
FIG. 1 is a schematic diagram of a structure of an antenna in some embodiments according to the present disclosure.
Figure 2A:
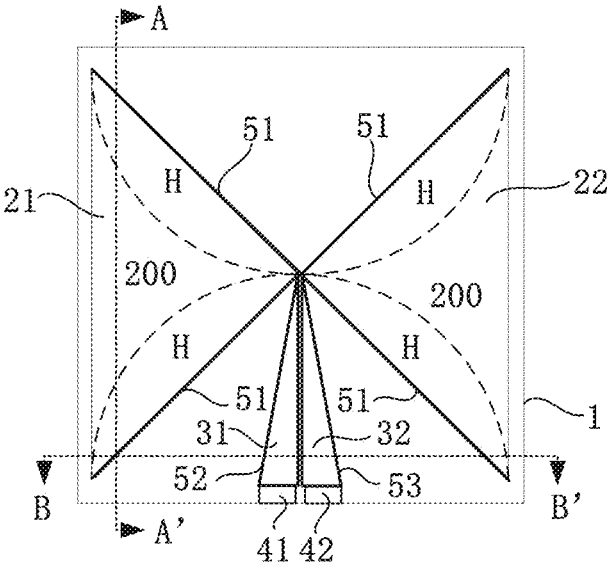
FIG. 2A is a schematic diagram of a structure of an antenna in some embodiments according to the present disclosure.

FIG. 1 is a schematic diagram of a structure of an antenna in some embodiments according to the present disclosure. FIG. 2A is a schematic diagram of a structure of an antenna in some embodiments according to the present disclosure. Referring to FIG. 1 and FIG. 2A, in some embodiments, the antenna includes a substantially transparent base substrate 1 and an antenna electrode 2 on the substantially transparent base substrate 1.

As used herein, the term "substantially transparent" means at least 50 percent (e.g., at least 60 percent at least 70 percent, at least 80 percent, at least 90 percent, and at least 95 percent) of an incident light in the visible wavelength range transmitted therethrough.

Optionally, the substantially transparent base substrate 1 is a glass substrate. Optionally, a dielectric constant $\varepsilon_r$ of the glass substrate is in a range of 8-15. Optionally, a thickness of the glass substrate is in a range of 0.1 mm to 20 mm, which may ensure that the antenna has a better radiation efficiency.

In some embodiments, the antenna electrode 2 includes a substantially transparent conductive layer 200; and a first conductive line 51 abutting an edge portion 20 of the substantially transparent conductive layer 200 and electrically connected to the edge portion 20 of the substantially transparent conductive layer 200. Optionally, an electrical conductivity of the first conductive line 51 is greater than an electrical conductivity of the substantially transparent conductive layer 200. Optionally, the first conductive line 51 is partially abutting the edge portion 20 of the substantially transparent conductive layer 200.

In some embodiments, the substantially transparent conductive layer 200 includes a high current density portion H which includes the edge portion 20 of the substantially transparent conductive layer 200. Optionally, when the antenna is configured to transmit or receive a signal, a current density in the high current density portion H of the substantially transparent conductive layer 200 is greater than a current density in other portions of the substantially transparent conductive layer 200.

As used herein, the term "current density" means a value of current passed through (A)/apparent electrode area (Δm2). For example, the current density in the high current density portion H of the substantially transparent conductive layer 200 is a ratio of a value of current passed through the high current density portion H to a value of an area of the high current density portion H.

In some embodiments, the high current density portion H has a relatively higher current density, so, the edge portion 20 of the substantially transparent conductive layer 200 in the high current density portion H also has a relatively higher current density. By disposing the first conductive line 51 on the edge portion 20 of the substantially transparent conductive layer 200, and making the first conductive line 51 to has the electrical conductivity greater than the electrical conductivity of the substantially transparent conductive layer 200, an energy transmission efficiency and a radiation efficiency of the antenna electrode 2 are effectively improved. Moreover, the first conductive line 51 is only abutting the edge portion 20 of the substantially transparent conductive layer 200, which may have little adversary effect on the transparency of the antenna, and may simplify a process of fabricating the antenna described herein and lower the cost of fabricating the antenna described herein.

Figure 2B:
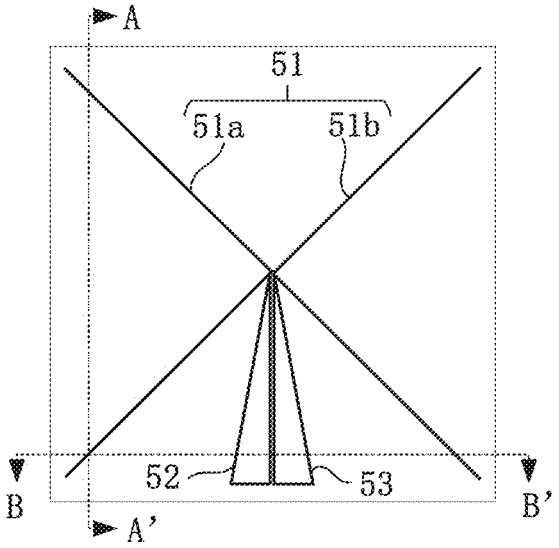
FIG. 2B illustrates conductive lines in an antenna in some embodiments according to the present disclosure.

The conductive lines in the present antenna may be continuous or discontinuous conductive lines. FIG. 2B illustrates conductive lines in an antenna in some embodiments according to the present disclosure. Referring to FIG. 2B, the first conductive line 51 includes a first continuous conductive line 51*a* and a second continuous conductive line 51*b*. The second conductive line 52 is a continuous conductive line, and the third conductive line 53 is a continuous conductive line.

Figure 2C:
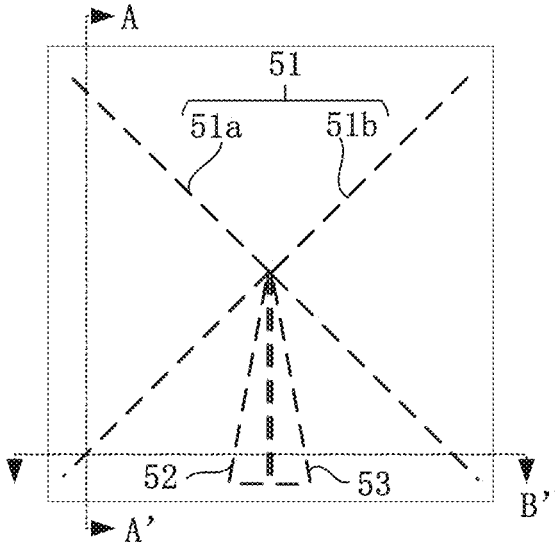
FIG. 2C illustrates conductive lines in an antenna in some embodiments according to the present disclosure.

FIG. 2C illustrates conductive lines in an antenna in some embodiments according to the present disclosure. Referring to FIG. 2C, the first conductive line 51 includes a first discontinuous conductive line 51*a* and a second discontinuous conductive line 51*b*. In one example, the first discontinuous conductive line 51*a* includes a plurality of conductive segments, and the second discontinuous conductive line 51*b* includes a plurality of conductive segments. The second conductive line 52 is a discontinuous conductive line, and the third conductive line 53 is a discontinuous conductive line. In another example, the second conductive line 52 includes a plurality of conductive segments, the third conductive line 53 includes a plurality of conductive segments.

Figure 3A:
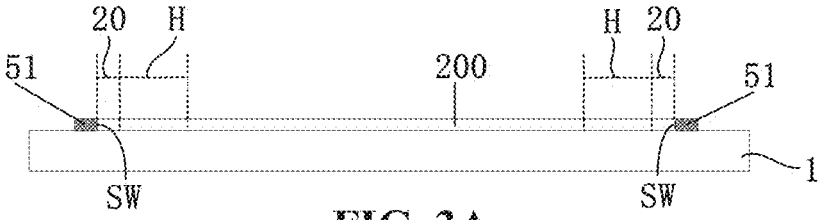
FIG. 3A is a cross-sectional view of the antenna along an AA' direction in the FIG. 2A.

FIG. 3A is a cross-sectional view of the antenna along an AA' direction in the FIG. 2A. Referring to FIG. 3A, in some embodiments, the first conductive line 51 is abutting the edge portion 20 of the substantially transparent conductive layer 200 along a side wall SW of the edge portion 20 of the substantially transparent conductive layer 200.

Figure 3B:
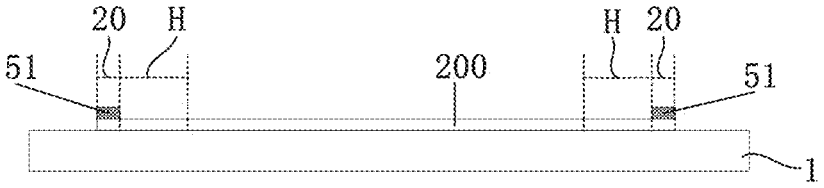
FIG. 3B is a cross-sectional view of the antenna along an AA' direction in the FIG. 2A.

FIG. 3B is a cross-sectional view of the antenna along an AA' direction in the FIG. 2A. Referring to FIG. 3B, in some embodiments, the first conductive line 51 is on a side of the edge portion 20 of the substantially transparent conductive layer 200 away from the substantially transparent base substrate 1.

Figure 3C:
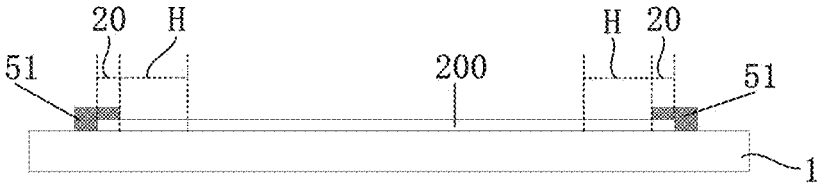
FIG. 3C is a cross-sectional view of the antenna along an AA' direction in the FIG. 2A.

FIG. 3C is a cross-sectional view of the antenna along an AA' direction in the FIG. 2A. Referring to FIG. 3C, in some embodiments, the first conductive line 51 covers the edge portion 20 of the substantially transparent conductive layer 200. Optionally, an orthographic projection of the first conductive line 51 on the substantially transparent base substrate 1 covers at least a portion of an orthographic projection of the edge portion 20 of the substantially transparent conductive layer 200 on the substantially transparent base substrate 1.

Various appropriate materials may be used for making the first conductive line 51. Examples of materials suitable for making the first conductive line 51 include, but are not limited to, metal nanowires. Optionally, the metal nanowires are one or a combination of silver nanowires and copper nanowires. Optionally, a width of a metal nanowires is in a range of 2 μm to 5 μm, e.g., 2 μm to 3 μm, 3 μm to 4 μm, and 4 μm to 5 μm.

In some embodiments, referring to FIG. 1 and FIG. 2A, the antenna further includes feed lines 3 on the substantially transparent base substrate 1 electrically connected to the antenna electrode 2. Optionally, the feed lines 3 and the antenna electrode 2 are in a same layer and includes a same conductive material.

As used herein, the term "same layer" refers to the relationship between the layers simultaneously formed in the same step. In one example, the feed lines 3 and the antenna electrode 2 are in a same layer when they are formed as a result of one or more steps of a same patterning process performed in a same layer of material. In another example, the feed lines 3 and the antenna electrode 2 can be formed in a same layer by simultaneously performing the step of forming the feed lines 3 and the step of forming the antenna electrode 2. The term "same layer" does not always mean that the thickness of the layer or the height of the layer in a cross-sectional view is the same.

For example, it is difficult to form a via on the substantially transparent conductive layer 200 of the antenna electrode 2, and also difficult to weld the feed lines 3 to the antenna electrode 2 through the via. The antenna adopt same layer feed mode instead of vertical bottom feed mode. So, the feed lines 3 and the antenna electrode 2 are in a same layer or a same plane.

In some embodiments, the feed lines 3 includes a first feed line 31 and the second feed line 32. Optionally, the antenna further includes a second conductive line 52 abutting an edge portion 310 of the first feed line 31 and electrically connected to the edge portion 310 of the first feed line 31, and a third conductive line 53 abutting an edge portion 320 of the second feed line 32 and electrically connected to the edge portion 320 of the second feed line 32.

Optionally, the electrical conductivity of the second conductive line 52 is greater than an electrical conductivity of the first feed line 31. Optionally, the electrical conductivity of the third conductive line 53 is greater than an electrically conductivity of the second feed line 32.

Optionally, the edge portion 310 of the first feed line 31 includes substantially an entirety of a perimeter of the first feed line 31. Optionally, the edge portion 320 of the second feed line 32 includes substantially an entirety of a perimeter of the second feed line 32.

Figure 3D:
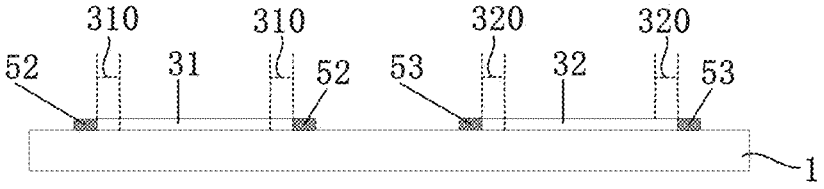
FIG. 3D is a cross-sectional view of the antenna along an BB' direction in the FIG. 2A.

FIG. 3D is a cross-sectional view of the antenna along an BB' direction in the FIG. 2A. In some embodiments, referring to FIG. 3D, the second conductive line 52 abuts the edge portion 310 of the first feed line 31 along a side wall of the edge portion 310 of the first feed line 31. Optionally, the third conductive line 53 abuts the edge portion 320 of the second feed line 32 along a side wall of the edge portion 320 of the second feed line 32.

Figure 3E:
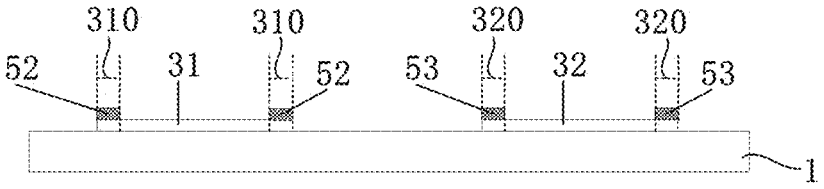
FIG. 3E is a cross-sectional view of the antenna along an BB' direction in the FIG. 2A.

FIG. 3E is a cross-sectional view of the antenna along an BB' direction in the FIG. 2A. Referring to FIG. 3E, in some embodiments, the second conductive line 52 is on a side of the edge portion 310 of the first feed line 31 away from the substantially transparent base substrate 1. Optionally, the third conductive line 53 is on a side of the edge portion 320 of the second feed line 32 away from the substantially transparent base substrate 1.

Figure 3F:
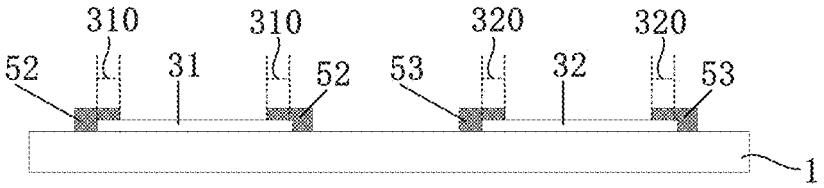
FIG. 3F is a cross-sectional view of the antenna along an BB' direction in the FIG. 2A.

FIG. 3F is a cross-sectional view of the antenna along an BB' direction in the FIG. 2A. In some embodiments, referring to FIG. 3F, the second conductive line 52 covers the edge portion 310 of the first feed line 31, the third conductive line 53 covers the edge portion 320 of the second feed line 32. Optionally, an orthographic projection of the second conductive line 52 on the substantially transparent base substrate 1 covers at least a portion of an orthographic projection of the edge portion 310 of the first feed line 31 on the substantially transparent base substrate 1. Optionally, an orthographic projection of the third conductive line 53 on the substantially transparent base substrate 1 covers at least a portion of an orthographic projection of the edge portion 320 of the second feed line 32 on the substantially transparent base substrate 1.

By forming the second conductive line 52 abutting the first feed line 31, forming the third conductive line 53 abutting the second feed line 32, making the second conductive line 52 to have the electrical conductivity greater than the electrical conductivity of the first feed line 31, and making the third conductive line 53 to have the electrical conductivity greater than the electrical conductivity of the second feed line 32, a radio frequency transmission efficiency of the combination of the first feed line 31 and the second conductive line 52 is greater than a radio frequency transmission efficiency of the first feed line 31, and a radio frequency transmission efficiency of the combination of the second feed line 32 and the third conductive line 53 is greater than a radio frequency transmission efficiency of the second feed line 32, so, an antenna gain of the antenna described herein is improved.

Optionally, the first conductive line 51, the second conductive line 52, and the third conductive line 53 are in a same layer and includes a same conductive material.

Various appropriate materials may be used for making the second conductive line 52 and the third conductive line 53. Examples of materials suitable for making the second conductive line 52 and the third conductive line 53 include, but are not limited to, metal nanowires. Optionally, the metal nanowires include silver nanowires and copper nanowires.

Optionally, a width of a metal nanowires is in a range of 2 μm to 5 μm, e.g., 2 μm to 3 μm, 3 μm to 4 μm, and 4 μm to 5 μm.

Figure 4A:
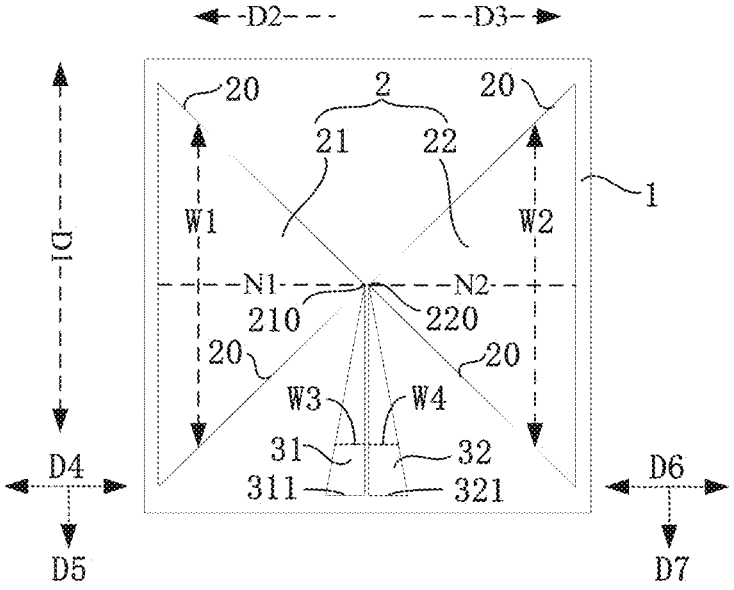
FIG. 4A is a schematic diagram of a structure of an antenna in some embodiments according to the present disclosure.

Optionally, the substantially transparent conductive 200, the first feed line 31, and the second feed line 32 are in a same layer and includes a same conductive material FIG. 4A is a schematic diagram of a structure of an antenna in some embodiments according to the present disclosure. Referring to FIG. 1, FIG. 2A, and FIG. 4A, in some embodiments, the substantially transparent conductive layer 200 includes a first pattern 21 having a first feed point 210 and a second pattern 22 having a second feed point 220 spaced apart from each other. In some embodiments, the antenna further includes the first feed line 31 electrically connected to the first pattern 21 through the first feed point 210, and the second feed line 32 electrically connected to the second pattern 22 through the second feed point 220. Optionally, the first feed point 210 of the first pattern 21 is closer to the second pattern 22. Optionally, the second feed point 220 of the second pattern 22 is closer to the first pattern 21.

Optionally, the substantially transparent conductive layer 200 further includes the first feed line 31 and the second feed line 32. Optionally, the substantially transparent conductive layer is an indium tin oxide (ITO) layer.

In some embodiments, a first width W1 along a first direction D1, of the first pattern 21, gradually increases along a second direction D2 substantially perpendicular to the first direction D1. Optionally, the first pattern 21 extends along the second direction D2 away from the second pattern 22.

As used herein, the term "substantially perpendicular" means that an angle is in the range of approximately 45 degrees to approximately 135 degrees, e.g., approximately 85 degrees to approximately 95 degrees, approximately 80 degrees to approximately 100 degrees, approximately 75 degrees to approximately 105 degrees, approximately 70 degrees to approximately 110 degrees, approximately 65 degrees to approximately 115 degrees, approximately 60 degrees to approximately 120 degrees, or approximately 90 degrees. For example, an angle between the second direction D2 and the first direction D1 is approximately 90 degrees.

In some embodiments, a second width W2 along the first direction D1, of the second pattern 22, gradually increases along a third direction D3 substantially opposite to the second direction D2 and substantially perpendicular to the first direction D1. Optionally, the second pattern 22 extends along the third direction D3 away from the first pattern 21.

As used herein, the term "substantially opposite" in the context of direction means that an included angle between two direction is in the range of approximately 135 degrees to approximately 225 degrees, e.g., approximately 170 degrees to approximately 190 degrees, approximately 160 degrees to approximately 200 degrees; approximately 150 degrees to approximately 210 degrees; approximately 140 degrees to approximately 220 degrees, approximately 135 degrees to approximately 225 degrees, or approximately 180 degrees. For example, an angle between the third direction D3 and the second direction is in the range of approximately 135 degrees to approximately 225 degrees.

In some embodiments, a third width W3 along a fourth direction D4, of the first feed line 31, gradually increases along a fifth direction D5 substantially perpendicular to the fourth direction D4.

In some embodiments, a fourth width W4 along a sixth direction D6, of the second feed line 32, gradually increases along a seventh direction D7 substantially perpendicular to the sixth direction D6.

In some embodiments, the fourth direction D4 and the six direction D6 are substantially perpendicular to the first direction D1. Optionally, the fifth direction D5 and the seventh direction D7 are substantially parallel to the first direction D1.

As used herein, the term "substantially parallel" means that an angle is in the range of 0 degree to approximately 45 degrees. e.g., 0 degree to approximately 5 degrees, 0 degree to approximately 10 degrees, 0 degree to approximately 15 degrees, 0 degree to approximately 20 degrees, 0 degree to approximately 25 degrees, 0 degree to approximately 30 degrees, or approximately 0 degree. In one example, an angle between the fifth direction D5 and the first direction D1 is in the range of 0 degree to approximately 45 degrees. In another example, an angle between the seventh direction D7 and the first direction D1 is in the range of 0 degree to approximately 45 degrees.

In some embodiments, the first pattern 21, the second pattern 22, the first feed line 31, and the second feed line 32 are in a same layer and include a same conductive material. Optionally, the conductive material is a transparent conductive material.

Optionally, the first pattern 21 and the second pattern 22 are in a same first layer, the first feed line 31 and the second feed line 32 are in a same second layer, the second layer is on a side of the first layer away from the substantially transparent base substrate 1 to allow the first feed line 31 to be electrically connected to the first pattern 21, and to allow the second feed line 32 to be electrically connected to the second pattern 22.

For example, it is difficult to form a via on the substantially transparent conductive layer containing the first pattern 21 and the second pattern 22, and also difficult to weld the first feed line to the first pattern and to weld the second fee line to the second pattern through vias. The antenna adopt same layer two-wire feed mode instead of vertical bottom feed mode. So, the first pattern 21, the second pattern 22, the first feed line 31, and the second feed line 32 are in a same layer or a same plane.

For example, the first feed line 31 has the third width W3 along the fourth direction D4, of the first feed line 31, gradually increasing along the fifth direction D5 substantially perpendicular to the fourth direction D4. The second feed line 32 has the fourth width W4 along the sixth direction D6, of the second feed line 32, gradually increasing along the seventh direction D7 substantially perpendicular to the sixth direction D6. In order to match an input impedance of the first pattern 21 at the first feed point 210 to a characteristic impedance of the first feed line 31 at the first feed point 210, the third width W3 along the fourth direction D4, of the first feed line 31, is designed to gradually increase along the fifth direction D5 substantially perpendicular to the fourth direction D4. In order to match an input impedance of the second pattern 22 at the second feed point 220 to a characteristic impedance of the second feed line 32 at the second feed point 220, the fourth width W4 along the sixth direction D6, of the second feed line 32, is designed to gradually increase along the seventh direction D7 substantially perpendicular to the sixth direction D6. So, by matching the input impedance of the first pattern 21 to the characteristic impedance of the first feed line 31, and matching the input impedance of the second pattern 22 to the characteristic impedance of the second feed line 32, the antenna can achieve a maximum transmission power, as well as keep the radiation pattern of the antenna stable when transmitting or receiving the ultra-wideband signals.

Various appropriate materials may be used for making the first pattern 21. Examples of materials suitable for making the first pattern 21 include, but are not limited to indium tin oxide (ITO), metal, and a combination of ITO and metal. In one example, the first pattern 21 is made of metal grid. In another example, the first pattern 21 is made of ITO material layer.

Various appropriate materials may be used for making the second pattern 22. Examples of materials suitable for making the second pattern 22 include, but are not limited to indium tin oxide (ITO), metal, and a combination of ITO and metal. In one example, the second pattern 22 is made of metal grid. In another example, the second pattern 22 is made of ITO material layer.

Various appropriate materials may be used for making the first feed line 31. Examples of materials suitable for making the first feed line 31 include, but are not limited to indium tin oxide (ITO), metal, and a combination of ITO and metal. In one example, the first feed line 31 is made of metal grid. In another example, the first feed line 31 is made of ITO material layer.

Various appropriate materials may be used for making the second feed line 32. Examples of materials suitable for making the second feed line 32 include, but are not limited to indium tin oxide (ITO), metal, and a combination of ITO and metal. In one example, the second feed line 32 is made of metal grid. In another example, the second feed line 32 is made of ITO material layer.

Optionally, a surface resistance of each of the first pattern 21, the second pattern 22, the first feed line 31, and the second feed line 32 is no more than 10 ohms, e.g., no more than 2 ohms, no more than 4 ohms, no more than 6 ohms, no more than 8 ohms, no more than 10 ohms, which may allow the antenna to transmit or receive signals efficiently.

Optionally, a thickness of each of the first pattern 21, the second pattern 22, the first feed line 31, and the second feed line 32 is in a range of approximately 300 nm to approximately 800 nm, e.g., approximately 300 nm to approximately 400 nm, approximately 400 nm to approximately 500 nm, approximately 500 nm to approximately 600 nm, approximately 600 nm to approximately 700 nm, and approximately 700 nm to approximately 800 nm. For example, the thicknesses of the first pattern 21, the second pattern 22, the first feed line 31, and the second feed line 32 are 500 nm.

In some embodiments, the first pattern 21 and the second pattern 22 together constitutes the antenna electrode 2 of the antenna.

Figure 4B:
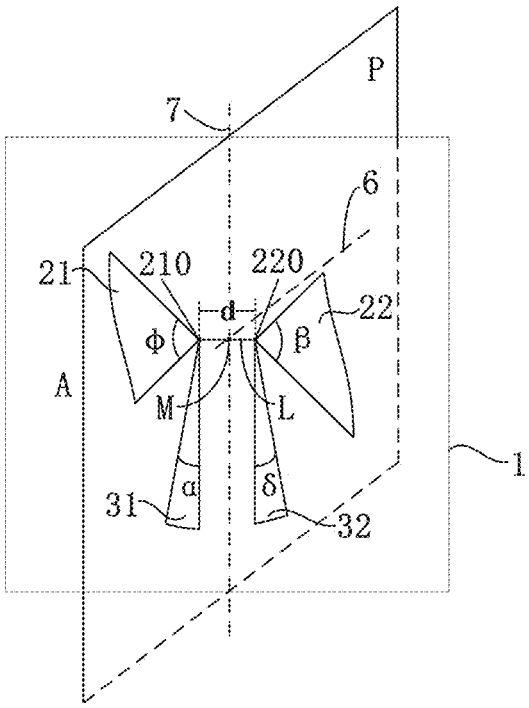
FIG. 4B is a zoom-in view of a first feed point, a second feed point, a first feed line, and a second feed in some embodiments according to the present disclosure.

FIG. 4B is a zoom-in view of a first feed point, a second feed point, a first feed line, and a second feed in some embodiments according to the present disclosure. Referring to FIG. 4A and FIG. 4B, in some embodiments, a first angle $\varphi$ is an acute angle between two sides of the first pattern 21 connecting to the first feed point 210, a second angle $\beta$ is an acute angle between two sides of the second pattern 22 connecting to the second feed point 220. Optionally, the first angle $\varphi$ and the second angle $\beta$ are substantially the same. Optionally, referring to FIG. 4A, the first pattern 21 has a same shape as the second pattern 22.

As used herein, the term "substantially the same" refers to a difference between two values not exceeding 10% of a base value (e.g., one of the two values), e.g., not exceeding 8%, not exceeding 6%, not exceeding 4%, not exceeding 2%, not exceeding 1%, not exceeding 0.5%, not exceeding 0.1%, not exceeding 0.05%, and not exceeding 0.01%, of the base value.

Optionally, a position of the first pattern 21 can be chosen from positions pivoting around the first feed point 210 and without overlapping with the second pattern 22, the first feed line 31, and the second feed line 32. Optionally, a position of the second pattern 22 can be chosen from positions pivoting around the second feed point 220 without overlapping with the first pattern 21, the first feed line 31, and the second feed line 32.

In some embodiments, referring to FIG. 4B, the first pattern 21 and the second pattern 22 have a two-fold symmetry with respective to a first two-fold axis 6 intersecting a midpoint M of a line L connecting the first feed point 210 and the second feed point 220, and perpendicular to the substantially transparent base substrate 1.

Optionally, the first pattern 21 and the second pattern 22 have a substantially mirror symmetry with respect to a plane of mirror symmetry P intersecting the midpoint M of the line L connecting the first feed point 210 and the second feed point 220, and perpendicular to the substantially transparent base substrate 1.

Optionally, the first pattern 21 and the second pattern 22 have a two-fold symmetry with respective to a second two-fold axis 7 on the plane of mirror symmetry P, intersecting the midpoint M, and parallel to the substantially transparent base substrate 1.

The symmetry arrangements of the first pattern 21 and the second pattern 22, the increasing first width W1 of the first pattern 21, and the increasing second width W2 allows the first pattern 21 and the second pattern 22 to have a broadband impedance characteristics, e.g., an ability to transmit or receive broadband signals. So, the antenna having the first pattern 21 and the second pattern 22 described herein has a transparent antenna able to transmit or receives ultra-wideband signals.

In some embodiments, referring to FIG. 4A, the first pattern 21 has a substantially triangular shape. As used herein, the term "substantial triangular shape" can include shapes or geometries having three sides extending along different directions (regardless of whether the three sides include straight lines, curved lines or otherwise).

Optionally, the first pattern 21 has a substantially isosceles triangular shape having the first feed point 210 as one of its apexes. As used herein, the term "substantially isosceles triangular shape" can include a shape or geometry having three sides extending along different directions, two base angles of which are substantially the same. The term "substantially isosceles triangular shape" encompasses isosceles triangular shapes in which the three sides are straight lines, curved lines, or any combination thereof. The term "substantially isosceles triangular shape" also encompass isosceles triangular shapes in which one or more corners are truncated.

Optionally, the first feed point 210 is one of apexes of the first pattern 21. Optionally, the first feed point 210 is an apex of a vertex angle other than two substantially the same base angles of the first pattern 21.

Optionally, the first pattern 21 has a substantially isosceles right triangular shape. As used herein, the term "substantially isosceles right triangular shape" can include a shape or geometry having three sides extending along different direction, two base angles of which are substantially the same, and a vertex angle of which is distinguished from the two base angles and is substantially 90 degrees. The term "substantially isosceles right triangular shape" encompasses isosceles right triangular shapes in which the three sides are straight lines, curved lines, or any combination thereof. The term "substantially isosceles right triangular shape" also encompass isosceles right triangular shapes in which one or more corners are truncated. Optionally, the first feed point 210 is an apex of a vertex angle having substantially 90 degrees among angles of the first pattern 21.

Optionally, the edge portion 20 of the substantially transparent conductive layer 200 includes at least a portion of two right angle sides of the first pattern 21 connected to the first feed point 210.

In some embodiment, the second pattern 22 has a substantially triangular shape. Optionally, the second pattern 22 has a substantially isosceles triangular shape. Optionally, the second feed point 220 is one of apexes of the second pattern 22. Optionally, the second feed point 220 is an apex of a vertex angle other than two substantially the same base angles of the second pattern 22.

Optionally, the second pattern 22 has a substantially isosceles right triangular shape having the second feed point 220 as one of its apexes. Optionally, the second feed point 220 is an apex of a vertex angle having substantially 90 degrees among angles of the second pattern 22.

Optionally, the edge portion 20 of the substantially transparent conductive layer 200 includes at least a portion of two right angle sides of the second pattern 22 connected to the second feed point 220.

For example, a shape, obtained after rotating the first pattern 21 and the second pattern 22 around the midpoint M for 90 degrees, is complementary to a shape of the first pattern 21 and the second pattern 22. This type of shape of the first pattern 21 and the second pattern 22 allows the antenna having the first pattern 21 and the second pattern 22 to transmit or receive ultra-wideband signals.

In some embodiments, the first pattern 21 has a sectorial shape, the second pattern 22 has a sectorial shape. Optionally, the first pattern 21 has a half elliptic shape, the second pattern 22 has a half elliptic shape.

Figure 4C:
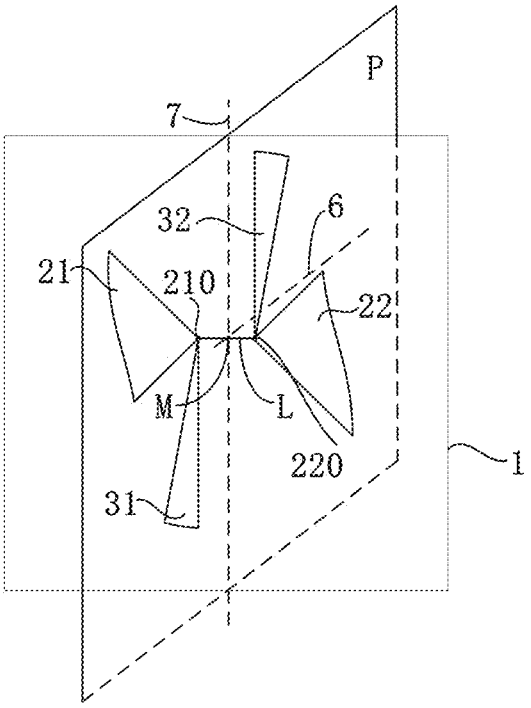
FIG. 4C is a zoom-in view of a first feed point, a second feed point, a first feed line, and a second feed in some embodiments according to the present disclosure.

FIG. 4C is a zoom-in view of a first feed point, a second feed point, a first feed line, and a second feed in some embodiments according to the present disclosure. Referring to FIG. 4C, in some embodiments, the first feed line 31 and the second feed line 32 have a two-fold symmetry with respective to the first two-fold axis 6.

In some embodiments, referring to FIG. 4A, the first feed line 31 and the second feed line 32 have a substantially triangular shape. Optionally, the first feed line 31 has a substantially isosceles triangular shape having the first feed point 210 as one of its apexes, and the second feed line 32 has a substantially isosceles triangular shape having the second feed point 220 as one of its apexes. Optionally, the first feed point 210 is an apex of a vertex angle other than two substantially the same base angles of the first feed line 31, the second feed point 220 is an apex of a vertex angle other than two substantially the same base angles of the second feed line 32. Optionally, one of two right angle sides of the first feed line 31 is directly adjacent to one of two right angle sides of the second feed line 32.

In some embodiments, the first feed line 31 has a rectangular shape, the second feed line 32 has a rectangular shape. Optionally, the first feed line 31 has a trapezoidal shape, the second feed line 22 has a trapezoidal shape.

In some embodiments, referring to FIG. 4A and FIG. 4B, the first feed point 210 and the second feed point 220 are closest points between the first pattern 21 and the second pattern 22 with respect to each other. Optionally, a distance d between the first feed point 210 and the second feed point 220 determines a maximum frequency with which a signal can be transmitted or received by the antenna. Optionally, an area of the first pattern 21 and an area of the second pattern 22 determines a minimum frequency with which a signal can be transmitted or received by the antenna.

In some embodiments, a first arm length of the first pattern 21 and the second arm length of the second pattern 22 determines the minimum frequency with which a signal can be transmitted or received by the antenna. For example, referring to FIG. 4A, the first arm length of the first pattern 21 is a first normal distance N1 between the first feed point 210 to a side of the first pattern 21 away from the first feed point 210. The second arm length of the second pattern 22 is a second normal distance N2 between the second feed point 220 to a side of the second pattern 22 away from the second feed point 220 also determines the minimum frequency with which a signal can be transmitted or received by the antenna. The longer the first arm length, the lower the minimum frequency signal the antenna can transmitted or receives. The longer the second arm length, the lower the minimum frequency signal the antenna can transmitted or receives.

For example, the first pattern 21 and the second pattern 22 have a substantial isosceles triangular shape. In one example, the first normal distance N1 is a height of the substantial isosceles triangular shape with respect to a side facing the vertex angle other than two substantially the same base angles of the isosceles triangular shape. In another example, the second normal distance N2 is a height of the substantial isosceles triangular shape with respect to a side facing the vertex angle other than two substantially the same base angles of the isosceles triangular shape.

Optionally, a relation between an arm length and the minimum frequency with which a signal can be transmitted or received by the antenna is represented by a following equation:

$$L=\gamma/4((L-97.82)/Z)$$

wherein, L represents the arm length, γ represents the minimum frequency with which a signal can be transmitted or received by the antenna, Z represents an impedance characteristic of an antenna electrode.

Optionally, the impedance characteristic is represented by a following equation:

$$Z=120\ \ln\cot(\theta/4)$$

wherein θ represents an angle of the antenna electrode with respect to a feed point. Optionally, the angle θ is in a range of approximately 60 degrees to approximately 90 degrees, e.g., approximately 60 degrees to approximately 70 degrees, approximately 70 degrees to approximately 80 degrees, approximately 80 degrees to approximately 90 degrees, and approximately 90 degrees.

For example, the angle θ of the first pattern 21 is the angle φ, the angle θ of the second pattern 22 is the angle β. Because the first pattern 21 and the second pattern 22 both have a same substantial isosceles right triangular shape, the angle φ of the first pattern 21 with respect to the first feed point is 90 degrees, and the angle β of the second pattern with respect to the second feed point is 90 degrees.

Optionally, the first normal distance N1 is in a range of approximately 10 mm to approximately 100 mm, e.g., approximately 10 mm to approximately 20 mm, approximately 20 mm to approximately 30 mm, approximately 30 mm to approximately 40 mm, approximately 40 mm to approximately 50 mm, approximately 50 mm to approximately 60 mm, approximately 60 mm to approximately 70 mm, approximately 70 mm to approximately 80 mm, approximately 80 mm to approximately 90 mm, and approximately 90 mm to approximately 100 mm.

Optionally, the second normal distance N2 is in a range of approximately 10 mm to approximately 100 mm, e.g., approximately 10 mm to approximately 20 mm, approximately 20 mm to approximately 30 mm, approximately 30 mm to approximately 40 mm, approximately 40 mm to approximately 50 mm, approximately 50 mm to approximately 60 mm, approximately 60 mm to approximately 70 mm, approximately 70 mm to approximately 80 mm, approximately 80 mm to approximately 90 mm, and approximately 90 mm to approximately 100 mm.

Optionally, the distance d between the first feed point 210 and the second feed point 220 is in a range of approximately 0.1 mm to approximately 10 mm, e.g., approximately 0.1 mm to approximately 1 mm, approximately 1 mm to approximately 2 mm, approximately 2 mm to approximately 3 mm, approximately 3 mm to approximately 4 mm, approximately 4 mm to approximately 5 mm, approximately 5 mm to approximately 6 mm, approximately 6 mm to approximately 7 mm, approximately 7 mm to approximately 8 mm, approximately 8 mm to approximately 9 mm, approximately 9 mm to approximately 10 mm.

For example, the first pattern 21 and the second pattern 22 have the same substantial isosceles right triangular shape. The first feed point 210 is an apex of a right angle of the first pattern 21. The second feed point 220 is an apex of a right angle of the second pattern 22. The first normal distance N1 of the first pattern 21 is 62 mm. The second normal distance N2 of the second pattern 22 is 62 mm. The distance d between the first feed point 210 and the second feed point 220 is 0.1 mm. So, a signal emitted from the antenna is in a range of approximately 0.8 GHz to approximately 6 GHz, e.g., approximately 0.8 GHz to approximately 1 GHz, approximately 1 GHz to approximately 2 GHz, approximately 2 GHz to approximately 3 GHz, approximately 3 GHz to approximately 4 GHz; approximately 4 GHz to approximately 5 GHz; approximately 5 GHz to approximately 6 GHz.

In some embodiments, referring to FIG. 4B, a third angle α is an acute angle between two sides of the first feed line 31 connected to the first feed point 210, a fourth angle δ is an acute angle between two sides of the second feed line 32 connected to the second feed point 220. Optionally, the third angle α and the fourth angle δ are substantially the same. Optionally, the first feed line 31 has a same shape of the second feed line 32. Optionally, a shape of first feed line 31 is different from a shape of the second feed line 32.

Optionally, a position of the first feed line 31 can be chosen from positions pivoting around the first feed point 210 and without overlapping with the first pattern 21, the second pattern 22, and the second feed line 32. Optionally, a position of the second feed line 32 can be chosen from positions pivoting around the second feed point 220 and without overlapping with the first pattern 21, second pattern 22, and the first feed line 31.

In some embodiments, first feed line 31 and the second feed line 32 have a substantially mirror symmetry with respect to the plane of mirror symmetry P. Optionally, the first feed line 31 and the second feed line 32 have a two-fold symmetry with respective to the second two-fold axis 7.

Referring to FIG. 4A, in some embodiments, a first side 311 of the first feed line 31 away from the first feed point 210 has a length in a range of approximately 5 mm to approximately 15 mm, e.g., approximately 5 mm to approximately 7 mm, approximately 7 mm to approximately 9 mm, approximately 9 mm to approximately 11 mm, approximately 11 mm to approximately 13 mm, and approximately 13 mm to approximately 15 mm.

Optionally, a second side 321 of the second feed line 32 away from the second feed point 220 has a length in a range of 5 mm to 15 mm, e.g., approximately 5 mm to approximately 7 mm, approximately 7 mm to approximately 9 mm, approximately 9 mm to approximately 11 mm, approximately 11 mm to approximately 13 mm, and approximately 13 mm to approximately 15 mm.

In some embodiments, referring to FIG. 2A, the antenna further includes a first metal structure 41 and a second metal structure 42. Optionally, the first metal structure 41 is electrically connected to the first side 311 of the first feed line 31 away from the first feed point 210. Optionally, the second metal structure 42 is electrically connected to a second side 321 of the second feed line 32 away from the second feed point 220.

Optionally, the first metal structure 41 performs radio frequency (RF) connection between the first feed line 31 and a RF cable. Optionally, the second metal structure 42 performs RF connection between the second feed line 32 and the RF cable. The first metal structure 41, and the second metal structure 42 allow the antenna to have a better RF energy transmission and improve transmission power.

Various materials may be used for making each one of the first metal structure 41 and the second metal structure 42. Examples of materials suitable for making each one of the first metal structure 41 and the second metal structure 42 include, but are not limited to, copper.

Optionally, the first side 311 of the first feed line 31 is on a first edge of the substantially transparent base substrate 1 closer to the first feed line 31. Optionally, the second side 321 of the second feed line 32 is on a second edge of the substantially transparent base substrate 1 closer to the second feed line 32. Optionally, the first edge and the second edge are the same edge.

Optionally, the first metal structure 41 is disposed on the first edge of the substantially transparent base substrate 1 closer to the first feed line 31 to be electrically connected to the first side 311 of the first feed line 31. Optionally, the second metal structure 42 is disposed on the second edge of the substantially transparent base substrate 1 closer to the second feed line 32 to be electrically connected to the second side 321 of the second feed line 32. It is convenient for the first metal structure 41 to connect the first feed line 31 and the RF cable, and for the second metal structure 42 to connect the second feed line 32 and the RF cable.

In some embodiments, the antenna further includes RF cable connectors respective connected to the first metal structure 41 and the second metal structure 42. Optionally, the RF cable connectors are respectively disposed on the first edge of the substantially transparent base substrate 1 closer to the first side 311 of the first feed line 31 and the second edge of the substantially transparent base substrate 1 closer to the second side 321 of the second feed line 32. By disposing the RF cable connectors, the connection between the first feed line 31, the second feed line 32, and the RF cable connectors is stable. Optionally, the RF cable connectors are respective connected to the first metal structure 41 and the second metal structure 42 by welding.

Figure 5:
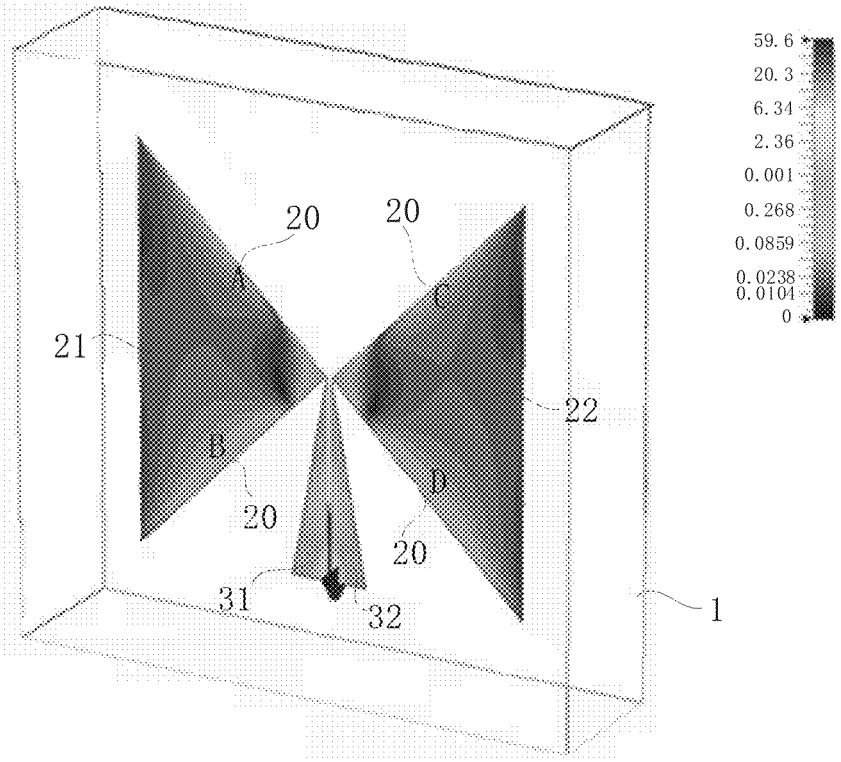
FIG. 5 is a schematic diagram illustrating a current density distribution of an antenna in some embodiments according to the present disclosure.

FIG. 5 is a schematic diagram illustrating a current density distribution of an antenna in some embodiments according to the present disclosure. Referring to FIG. 5, a scale bar on the left-top of the FIG. 5 represents different current densities, which are measured by A/m(log). In some embodiments, when the first pattern 21 and the second pattern 22 has a substantially isosceles triangular shape, current densities of two legs of the substantially isosceles triangular shape are greater than current densities of other portions of the substantially isosceles triangular shape. Optionally, current densities of two sides of the first pattern 21 connected to the first feed point 210 are greater than current densities of other portions of the first pattern 21. Optionally, current densities of two sides of the second pattern 22 connected to the second feed point 220 are greater than current densities of other portions of the second pattern 22.

In some embodiments, the high current density portion H of the substantially transparent conductive layer 200 (e.g., the first pattern 21 and the second pattern 22) includes portion A, portion B, portion C. and portion D in FIG. 5. Optionally, the edge portion 20 of the substantially transparent conductive layer 200 includes two sides of the first pattern 21 connected to the first feed point 210 and two sides of the second pattern 22 connected to the second feed point 220. For example, the first conductive line 51 is abutting the two sides of the first pattern 21 connected to the first feed point 210 and the two sides of the second pattern 22 connected to the second feed point 220, which can greatly improve the radio frequency transmission efficiency and the antenna gain of the antenna described herein.

Figure 6:
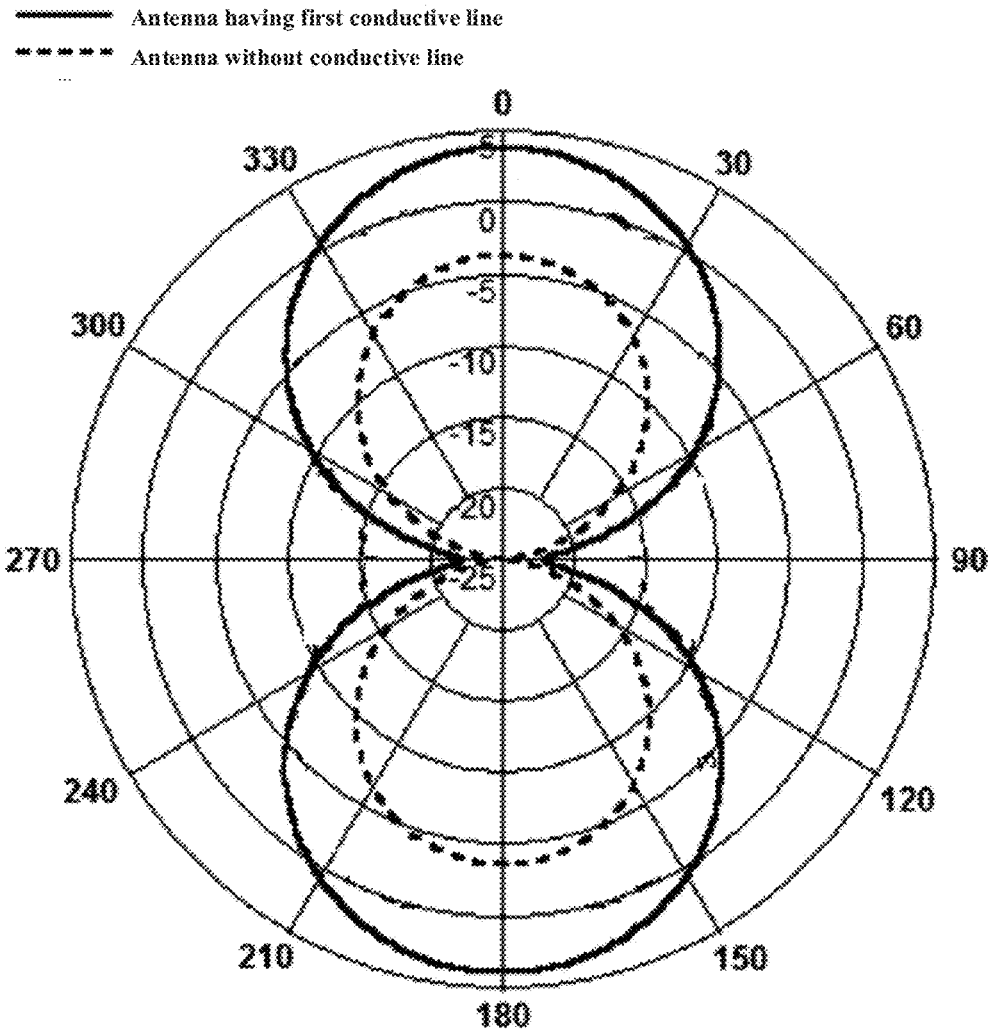
FIG. 6 is a schematic diagram illustrating a comparison between an E-plane of a radiation pattern of an antenna having a first conductive line and an E-plane of a radiation pattern of an antenna without a conductive line in some embodiments according to the present disclosure.

FIG. 6 is a schematic diagram illustrating a comparison between an E-plane of a radiation pattern of an antenna having a first conductive line and an E-plane of a radiation pattern of an antenna without a conductive line in some embodiments according to the present disclosure. Referring to FIG. 6, a dotted line represents a radiation pattern of an antenna having substantially isosceles right triangular first pattern and second pattern, but without conductive line abutting the first pattern and the second pattern. A solid line represents a radiation pattern of an antenna having a shape identically to a shape of the antenna represented by the dotted line, but having the first conductive line abutting the edge portion of the first pattern and the second pattern.

Referring to FIG. 6, numbers 0, 30, 60, . . . , 300, 330 represent radiation angles of the antennas, which are measured by degrees (°), numbers 5, 0, −5, . . . , −25 represent antenna gains of the antennas, which are measured by decibels (dB). Comparing the E-plane of a radiation pattern of the antenna without a conductive line (see the dotted line) to the E-plane of a radiation pattern of the antenna having the first conductive line (see the solid line), a range of radiation angles covered by the solid line is greater than a range of radiation angles covered by the dotted line, and the range of antenna gains covered by the solid line is greater than a range of antenna gains covered by the dotted line. So, the antenna having the first conductive line has a greater range of radiation angles, and a greater range of antenna gains.

For example, along a direction of 0 degree radiation angle, the antenna gain of the antenna having the first conductive line is 7 dB to 8 dB greater than the antenna gain of the antenna without a conductive line. It is disclosed in the present disclosure that by disposing the first conductive line having a relatively higher electrical conductivity on the edge portion 20 of the substantially transparent conductive layer 200 of the antenna electrode 2, the radiation efficiency of the antenna can be greatly improved.

In another aspect, the present disclosure also provides a smart window. In some embodiments, the smart window includes the antenna described herein (e.g., the antenna having the first conductive line). Optionally, the smart window includes one or more signals lines connected to the antenna.

Optionally, a shape of the substantially transparent base substrate can form a shape of the smart window. In one example, subsequent to forming the smart window using the substantially transparent base substrate, other elements of the antenna including, but are not limited to the antenna electrode, the first feed line, the second feed line are formed on the transparent base substrate. In another example, prior to forming the smart window using the substantially transparent base substrate, other elements of the antenna including, but are not limited to the antenna electrode, the first feed line, the second feed line are formed on the transparent base substrate.

Figure 7:
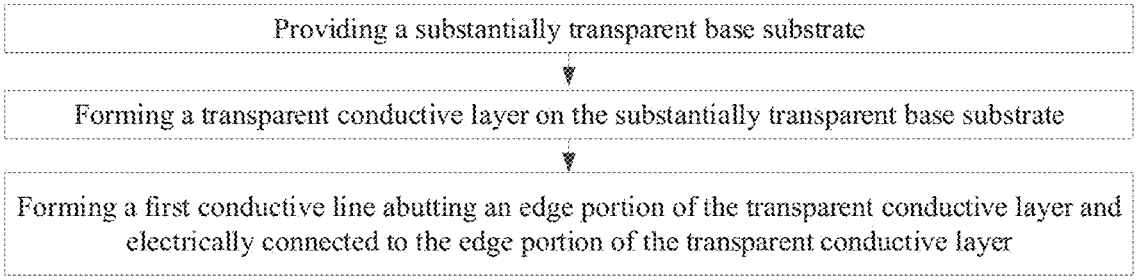
FIG. 7 is a flow chart illustrating a method of fabricating an antenna in some embodiments according to the present disclosure.

In another aspect, the present disclosure also provides a method of fabricating an antenna configured to transmit or receive a signal. FIG. 7 is a flow chart illustrating a method of fabricating an antenna in some embodiments according to the present disclosure, referring to FIG. 7, in some embodiments, the method includes forming a substantially transparent base substrate; and forming an antenna electrode on the substantially transparent base substrate. Optionally, forming the antenna electrode includes forming a substantially transparent conductive layer on the substantially transparent base substrate; and forming a first conductive line abutting an edge portion of the substantially transparent conductive layer and electrically connected to the edge portion of the substantially transparent conductive layer. Optionally, an electrical conductivity of the first conductive line is greater than an electrical conductivity of the substantially transparent conductive layer.

Optionally, forming the antenna electrode includes forming a substantially transparent conductive material layer on the substantially transparent base substrate; patterning the substantially transparent conductive material layer to obtain the substantially transparent conductive layer. Optionally, the substantially transparent conductive layer includes a high current density portion which includes the edge portion of the substantially transparent conductive layer. Optionally, when the antenna is configured to transmit or receive a signal, a current density in the high current density portion of the substantially transparent conductive layer is greater than a current density in other portions of the substantially transparent conductive layer.

Optionally, forming the first conductive line abutting the edge portion of the substantially transparent conductive layer includes forming the first conductive line on a side of the edge portion of the substantially transparent conductive layer away from the substantially transparent base substrate. Optionally, forming the first conductive line abutting the edge portion of the substantially transparent conductive layer includes forming the first conductive line abutting the edge portion of the substantially transparent conductive layer along a side wall of the edge portion of the substantially transparent conductive layer.

Optionally, the first conductive line 51 is made of metal nanowires. For example, the first conductive line 51 is made of one or a combination of silver nanowires and copper nanowires.

Optionally, a width of the first conductive line 51 is in a range of 2 μm to 5 μm, e.g., 2 μm to 3 μm, 3 μm to 4 μm, and 4 μm to 5 μm.

In some embodiments, the method further include forming feed lines connected to the antenna electrode on the substantially transparent base substrate. Optionally, the feed lines and the antenna electrode are formed in a same process of patterning the substantially transparent conductive material layer. Optionally, the feed lines and the antenna electrode are formed in different processes. Optionally, the feed lines are formed to have a first feed line and the second feed line electrically connected to the antenna electrode.

It is difficult to form a via on the substantially transparent conductive layer of the antenna electrode, and also difficult to weld the feed lines to the antenna electrode through the via. The antenna adopt same layer feed mode instead of vertical bottom feed mode. So, the feed lines and the antenna electrode are in a same layer or a same plane.

In some embodiments, the method further includes forming a second conductive line abutting an edge portion of the first feed line and electrically connected to the edge portion of the first feed line, and forming a third conductive line abutting an edge portion of the second feed line and electrically connected to the edge portion of the second feed line.

Optionally, the electrical conductivity of the second conductive line is greater than an electrical conductivity of the first feed line. Optionally, the electrical conductivity of the third conductive line is greater than an electrical conductivity of the second feed line.

Optionally, the first conductive line, the second conductive line, and the third conductive line are in a same layer and have a same conductive material. For example, the first conductive line, the second conductive line, and the third conductive line are made of metal nanowires, such as silver nanowires or copper nanowires.

Optionally, the substantially transparent conductive layer includes indium tin oxide (ITO). Optionally, the first feed line and the second feed line also includes ITO.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. An antenna configured to transmit or receive a signal, comprising:

a substantially transparent base substrate and an antenna electrode on the substantially transparent base substrate;

wherein the antenna electrode comprises:

a substantially transparent conductive layer; and a first conductive line abutting an edge portion of the substantially transparent conductive layer and electrically connected to the edge portion of the substantially transparent conductive layer;

wherein an electrical conductivity of the first conductive line is greater than an electrical conductivity of the substantially transparent conductive layer;

the substantially transparent conductive layer comprises a first pattern having a first feed point and a second pattern having a second feed point spaced apart from each other;

a first width along a first direction, of the first pattern, gradually increases along a second direction substantially perpendicular to the first direction; and a second width along the first direction, of the second pattern, gradually increases along a third direction substantially opposite to the second direction and substantially perpendicular to the first direction;

wherein the antenna further comprises:

a first feed line electrically connected to the first pattern through the first feed point; and a second feed line electrically connected to the second pattern through the second feed point;

wherein a third width along a fourth direction, of the first feed line, gradually increases along a fifth direction substantially perpendicular to the fourth direction;

a fourth width along a sixth direction, of the second feed line, gradually increases along a seventh direction substantially perpendicular to the sixth direction;

the fourth direction and the sixth direction are substantially perpendicular to the first direction; and the fifth direction and the seventh direction are substantially parallel to the first direction;

wherein at least one of the first pattern, the second pattern, the first feed line, or the second feed line is made of a metal grid.

2. The antenna of claim 1, wherein the substantially transparent conductive layer comprises a high current density portion which comprises the edge portion of the substantially transparent conductive layer; and when the antenna is configured to transmit or receive a signal, a current density in the high current density portion of the substantially transparent conductive layer is greater than a current density in other portions of the substantially transparent conductive layer.

3. The antenna of claim 1, wherein each of the first pattern, the second pattern, the first feed line, and the second feed line is made of a metal grid.

4. The antenna of claim 1, wherein the first pattern and the second pattern have a two-fold symmetry with respective to a two-fold axis intersecting a midpoint of a line connecting the first feed point and the second feed point, and perpendicular to the substantially transparent base substrate; and the first pattern and the second pattern have a substantially mirror symmetry with respect to a plane of mirror symmetry intersecting the midpoint of the line connecting the first feed point and the second feed point, and perpendicular to the substantially transparent base substrate.

5. The antenna of claim 1, wherein the first feed point and the second feed point are closest points between the first pattern and the second pattern with respect to each other.

6. The antenna of claim 1, wherein the first pattern has a substantial isosceles right triangular shape having the first feed point as one of its apexes;

the second pattern has a substantially isosceles right triangular shape having the second feed point as one of its apexes; and the edge portion of the substantially transparent conductive layer comprises at least a portion of two right angle sides of the first pattern connected to the first feed point, and at least a portion of two right angle sides of the second pattern connected to the second feed point.

7. The antenna of claim 1, wherein a first normal distance between the first feed point to a side of the first pattern away from the first feed point is in a range of approximately 10 mm to approximately 100 mm;

a second normal distance between the second feed point to a side of the second pattern away from the second feed point is in a range of approximately 10 mm to approximately 100 mm; and a distance between the first feed point and the second feed point is in a range of approximately 0.1 mm to approximately 10 mm.

8. The antenna of claim 1, wherein the first conductive line is on a side of the edge portion of the substantially transparent conductive layer away from the substantially transparent base substrate.

9. The antenna of claim 1, wherein the first conductive line is abutting the edge portion of the substantially transparent conductive layer along a side wall of the edge portion of the substantially transparent conductive layer.

10. The antenna of claim 1, wherein the first feed line and the second feed line have a substantially mirror symmetry with respect to a plane of mirror symmetry.

11. The antenna of claim 1, wherein the first feed line and the second feed line have a substantially right triangular shape; and one of two right angle sides of the first feed line is directly adjacent to one of two right angle sides of the second feed line.

12. The antenna of claim 1, further comprising:

a second conductive line abutting an edge portion of the first feed line and electrically connected to the edge portion of the first feed line; and a third conductive line abutting an edge portion of the second feed line and electrically connected to the edge portion of the second feed line.

13. The antenna of claim 12, wherein the edge portion of the first feed line comprises substantially an entirety of a perimeter of the first feed line; and the edge portion of the second feed line comprises substantially an entirety of a perimeter of the second feed line.

14. The antenna of claim 12, wherein the second conductive line is on a side of the edge portion of the first feed line away from the substantially transparent base substrate; and the third conductive line is on a side of the edge portion of the second feed line away from the substantially transparent base substrate.

15. The antenna of claim 12, wherein the second conductive line abuts the edge portion of the first feed line along a side wall of the edge portion of the first feed line; and the third conductive line abuts the edge portion of the second feed line along a side wall of the edge portion of the second feed line.

16. The antenna of claim 12, wherein the substantially transparent conductive layer, the first feed line, and the second feed line are in a same layer and comprise a same conductive material; and the first conductive line, the second conductive line, and the third conductive line are in a same layer and comprise a same conductive material.

17. The antenna of claim 13, further comprising a first metal structure and a second metal structure;

wherein the first metal structure is electrically connected to a first side of the first feed line away from the first feed point; and the second metal structure is electrically connected to a second side of the first feed line away from the second feed point.

18. A smart window, comprising the antenna of claim 1, and one or more signals lines connected to the antenna.

19. A method of fabricating an antenna configured to transmit or receive a signal, comprising:

providing a substantially transparent base substrate; and forming an antenna electrode on the substantially transparent base substrate;

wherein forming the antenna electrode comprises forming a substantially transparent conductive layer on the substantially transparent base substrate; and forming a first conductive line abutting an edge portion of the substantially transparent conductive layer and electrically connected to the edge portion of the substantially transparent conductive layer;

wherein an electrical conductivity of the first conductive line is greater than an electrical conductivity of the substantially transparent conductive layer;

forming the substantially transparent conductive layer comprises forming a first pattern having a first feed point and forming a second pattern having a second feed point spaced apart from each other;

a first width along a first direction, of the first pattern, gradually increases along a second direction substantially perpendicular to the first direction; and a second width along the first direction, of the second pattern, gradually increases along a third direction substantially opposite to the second direction and substantially perpendicular to the first direction;

wherein forming the antenna further comprises:

forming a first feed line electrically connected to the first pattern through the first feed point; and forming a second feed line electrically connected to the second pattern through the second feed point;

wherein a third width along a fourth direction, of the first feed line, gradually increases along a fifth direction substantially perpendicular to the fourth direction;

a fourth width along a sixth direction, of the second feed line, gradually increases along a seventh direction substantially perpendicular to the sixth direction;

the fourth direction and the sixth direction are substantially perpendicular to the first direction; and the fifth direction and the seventh direction are substantially parallel to the first direction;

wherein at least one of the first pattern, the second pattern, the first feed line, or the second feed line is made of a metal grid.

20. The method of claim 19, wherein each of the first pattern, the second pattern, the first feed line, and the second feed line is made of a metal grid.

* * * * *